US006592049B1

(12) United States Patent
Wolput

(10) Patent No.: US 6,592,049 B1
(45) Date of Patent: Jul. 15, 2003

(54) WATER MISTING DEVICE

(76) Inventor: Matthew Van Wolput, 63 N. Lyons Rd., Oak Ridge, NJ (US) 07438

( * ) Notice: Subject to any disclaimer, the term of this patent is extended or adjusted under 35 U.S.C. 154(b) by 0 days.

(21) Appl. No.: 10/184,825

(22) Filed: Jun. 28, 2002

(51) Int. Cl.[7] ..... B05B 12/08

(52) U.S. Cl. ..... 239/70; 239/67; 239/211; 239/273; 239/276; 239/289; 239/330

(58) Field of Search ..... 239/67, 70, 289, 239/211, 273, 276, 330

(56) References Cited

U.S. PATENT DOCUMENTS 3,185,397 A * 5/1965 Nelson ..... 239/556
3,295,886 A * 1/1967 Goldmerstein ..... 297/180.14
4,171,092 A * 10/1979 Ragsdale ..... 239/70
4,272,025 A * 6/1981 Mazzotti ..... 239/240
4,396,149 A * 8/1983 Hirsch ..... 239/63
4,765,542 A * 8/1988 Carlson ..... 239/289
4,852,802 A * 8/1989 Iggulden et al. ..... 239/64
4,854,502 A * 8/1989 Cox ..... 239/124
4,974,779 A * 12/1990 Araki et al. ..... 239/18
5,000,384 A * 3/1991 Arnold ..... 239/128
5,121,882 A * 6/1992 Skidmore ..... 239/269
5,301,457 A * 4/1994 Seely ..... 43/132.1
5,330,104 A * 7/1994 Marcus ..... 239/266
5,390,852 A * 2/1995 Schuenemann et al. .. 239/263.1
5,740,970 A * 4/1998 Edwards ..... 239/551
5,794,849 A * 8/1998 Elder ..... 239/99
6,155,495 A * 12/2000 Jones ..... 239/289
6,325,362 B1 * 12/2001 Massey et al. ..... 261/127

* cited by examiner

*Primary Examiner*—Gregory Huson
*Assistant Examiner*—Azy Kokabi

(57) ABSTRACT

A water misting device has a hook and loop fastener connected to a nozzle mounting assembly. The nozzle mounting assembly has an inlet tube bore and a connected nozzle bore. A misting nozzle is attached to the nozzle mounting assembly. A water inlet tube is connected to the nozzle mounting assembly. An electrically driven water pump is connected to the water inlet tube. A timer is electrically connected to the water pump for selectively powering the water pump to intermittently force the flow of water through the water pump. A power supply connection is electrically connected to the timer.

4 Claims, 4 Drawing Sheets

WATER MISTING DEVICE

BACKGROUND OF THE INVENTION

1. Field of the Invention

The present invention relates to a water misting device for use in connection with liquid spraying devices. The water misting device has particular utility in connection with water misting device attachable to a lounge chair.

2. Description of the Prior Art

Water misting devices are desirable for cooling users who are sunbathing, or watching sporting events. Typically these activities take place in the out of doors in the sunshine and usually during the summer when the temperature is elevated. Profuse sweating can occur during these events making the event uncomfortable. The use of misters can be used to reduce body temperatures, a need was felt for a mister that was attachable to a lounge chair that intermittently mists the user to reduce their body temperature over an extended period of time.

The use of liquid spraying devices is known in the prior art. For example, U.S. Pat. No. 5,121,882 to Skidmore discloses a mist apparatus for sunbathing that comprises a pair of pipe sections having perforations along the lengths thereof for mounting mist producing nozzles. A flexible hose connects the pipes one to the other and a valve at an inlet to the pipe assembly controls the flow of water through the pipes. A cap at one end of the apparatus seals the pipe assembly and causes water flowing into the pipes to be forced through the nozzles, thereby producing a fine mist. The flexible hose not only permits adjustment of the distance between the pipes to facilitate use by a number of sunbathers, but also enables the apparatus to be folded for transportation or storage. However, the Skidmore '882 patent does not provide a spray timer, an electrical water pump, a hook and loop fastener, a ground stake mounting port and individual misting nozzle valves.

Similarly, U.S. Pat. No. 5,000,384 to Arnold discloses a water misting apparatus for a chair that includes several spray nozzles attached to the chair with each spray nozzle to be individually adjustable to vary the direction of flow from the nozzles. The flow from the nozzles is to be directed so that a mist is sprayed onto an occupant of the chair. The nozzles are supplied water from a series of conduits that are in turn connected to a pressurized supply tank. The conduit assembly includes a heat exchanger that can be utilized to either increase or decrease the temperature of the water. However, the Arnold '384 patent does not provide a spray timer, an electrical water pump, a hook and loop fastener, a ground stake mounting port and individual misting nozzle valves.

Lastly, U.S. Pat. No. 4,765,542 to Carlson discloses a liquid misting attachment for sunbather's chair that provides a manually controlled, self contained liquid misting attachment for web covered folding chairs useful for sunbathing. A tubular pliable H-frame fits the chair frame and is attached by retainers. A pressurized water tank supplies liquid controllably to the H-frame and to the spaced adjustable mist producing heads in paralleling surfaces of the H-frame conduits. The sunbather, reclining on a lounge or sitting on a chair to which the liquid misting attachment is fastened, can selectively apply misted water or sun effecting liquids to his or her body by manually pressurizing a spring biasing normally closed control valve. However, the Carlson '542 patent does not provide a spray timer, an electrical water pump, a hook and loop fastener, a ground stake mounting port and individual misting nozzle valves.

While the above-described devices fulfill their respective, particular objectives and requirements, the aforementioned patents do not describe a water misting device that allows water misting device attachable to a lounge chair. The Skidmore '882, Arnold '384 and Carlson '542 patents make no provision for a spray timer, an electrical water pump, a hook and loop fastener, a ground stake mounting port and individual misting nozzle valves.

Therefore, a need exists for a new and improved water misting device which can be used for water misting device attachable to a lounge chair. In this regard, the present invention substantially fulfills this need. In this respect, the water misting device according to the present invention substantially departs from the conventional concepts and designs of the prior art, and in doing so provides an apparatus primarily developed for the purpose of water misting device attachable to a lounge chair.

SUMMARY OF THE INVENTION

In view of the foregoing disadvantages inherent in the known types of liquid spraying devices now present in the prior art, the present invention provides an improved water misting device, and overcomes the above-mentioned disadvantages and drawbacks of the prior art. As such, the general purpose of the present invention, which will be described subsequently in greater detail, is to provide a new and improved water misting device and method which has all the advantages of the prior art mentioned heretofore and many novel features that result in a water misting device which is not anticipated, rendered obvious, suggested, or even implied by the prior art, either alone or in any combination thereof.

To attain this, the present invention essentially comprises a hook and loop fastener connected to nozzle mounting assembly. The nozzle mounting assembly has an inlet tube bore and a connected nozzle bore. A misting nozzle is attached to the nozzle mounting assembly. A water inlet tube is connected to the nozzle mounting assembly. An electrically driven water pump is connected to the water inlet tube. A timer is electrically connected to the water pump for selectively powering the water pump to intermittently force the flow of water through the water pump. A power supply connection is electrically connected to the timer.

There has thus been outlined, rather broadly, the more important features of the invention in order that the detailed description thereof that follows may be better understood and in order that the present contribution to the art may be better appreciated.

The invention may also include a ground stake bore in the nozzle mounting assembly, a nozzle valve, a water reservoir, a power switch, a housing and a ground stake holder. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved water misting device that has all of the advantages of the prior art liquid spraying devices and none of the disadvantages.

It is another object of the present invention to provide a new and improved water misting device that ma y be easily and efficiently manufactured and marketed.

An even further object of the present invention is to provide a new and improved water misting device that has a low cost of manufacture with regard to both materials and labor, and which accordingly is then susceptible of low prices of sale to the consuming public, thereby making such water misting device economically available to the buying public.

Still another object of the present invention is to provide a new water misting device that provides in the apparatuses and methods of the prior art some of the advantages thereof, while simultaneously overcoming some of the disadvantages normally associated therewith.

Even still another object of the present invention is to provide a water misting device for water misting device attachable to a lounge chair.

Lastly, it is an object of the present invention is to provide a water misting device for providing relief from the heat on a hot day while participating in outdoor activities in hot weather.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
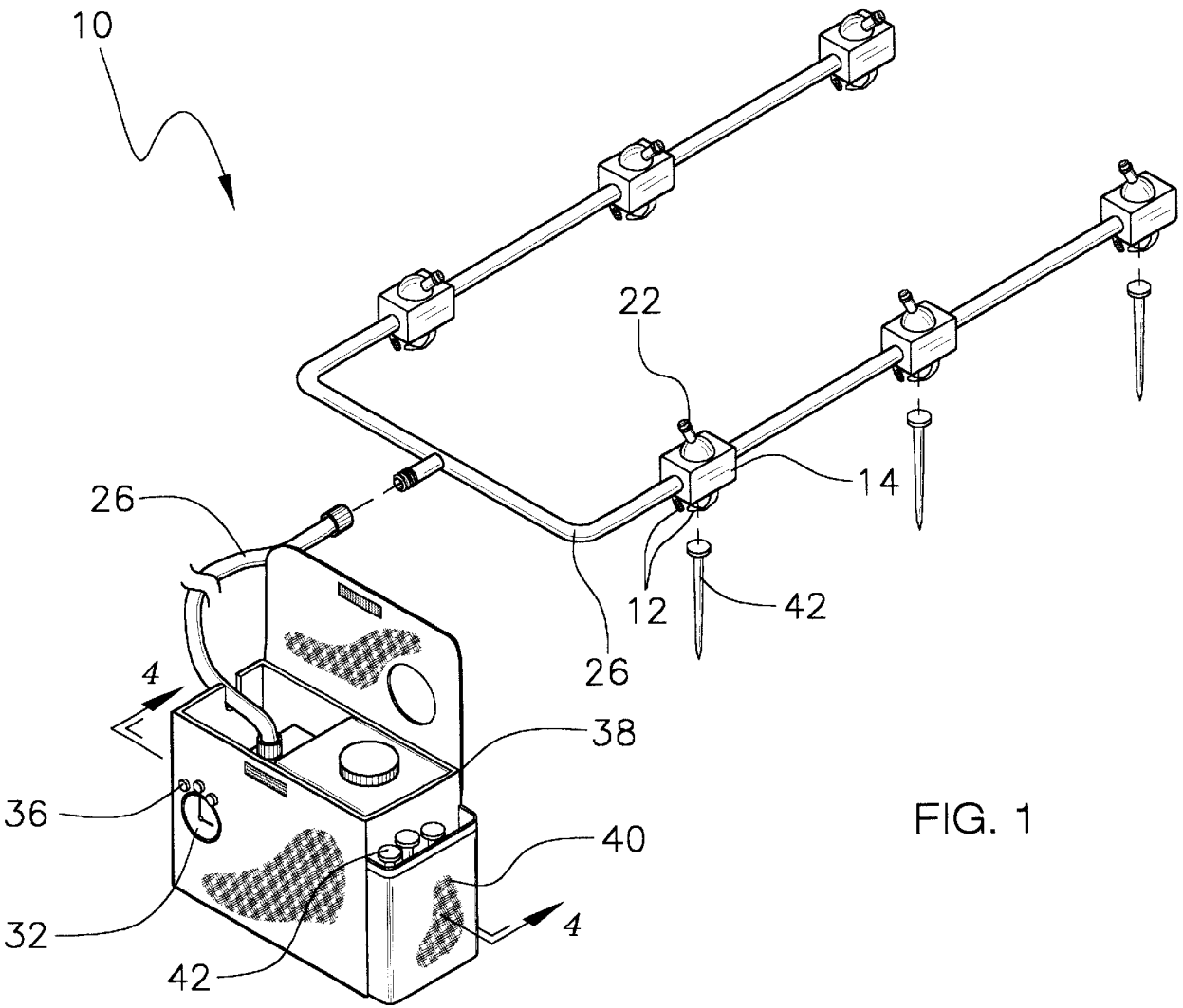
FIG. 1 is a top perspective view of the preferred embodiment of the water misting device constructed in accordance with the principles of the present invention.

Referring now to the drawings, and particularly to FIGS. 1–4, a preferred embodiment of the water misting device of the present invention is shown and generally designated by the reference numeral 10.

In FIG. 1, a new and improved water misting device 10 of the present invention for water misting device attachable to a lounge chair is illustrated and will be described. More particularly, the water misting device 10 has a hook and loop fastener 12 connected to a nozzle mounting assembly 14. The nozzle mounting assembly 14 has a ground stake bore therein 20. A misting nozzle 22 is attached to the nozzle mounting assembly 14. A nozzle valve 24 is connected to the misting nozzle 22 for selectively metering the flow of water through the misting nozzle 22. A water inlet tube 26 is connected to the nozzle mounting assembly 14. A timer 32 is programmable in the present example. A power switch 36 is electrically connected to the timer 32, for selectively powering the timer 32 and a water pump 28 (shown in FIG. 2). A housing 38 is attached to the timer 32. A ground stake holder 40 is attached to the housing 38, for holding a ground stake 42.

Figure 2:
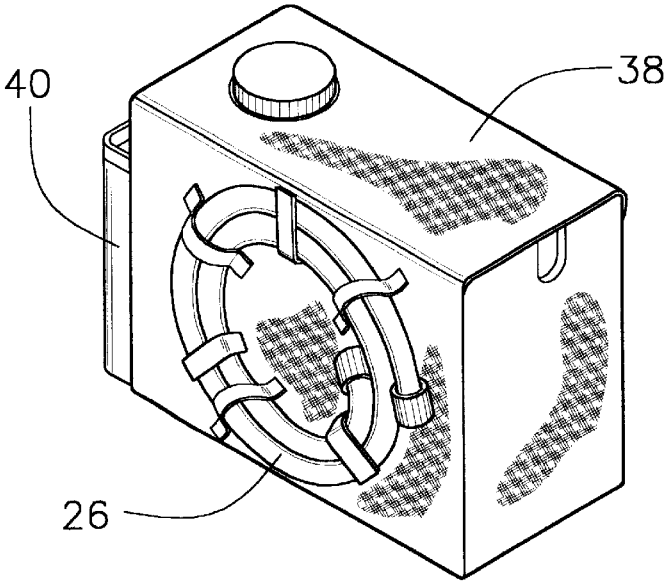
FIG. 2 is a perspective view of the water misting device of the present invention.

In FIG. 2, the water misting device 10 of the present invention is illustrated and will be described. The water misting device 10 comprises an external housing 38. A ground stake holder 40 is attached to the housing 38 for holding ground stakes. Additionally, a water inlet tube 26 may by attachment to said housing 38.

Figure 3:
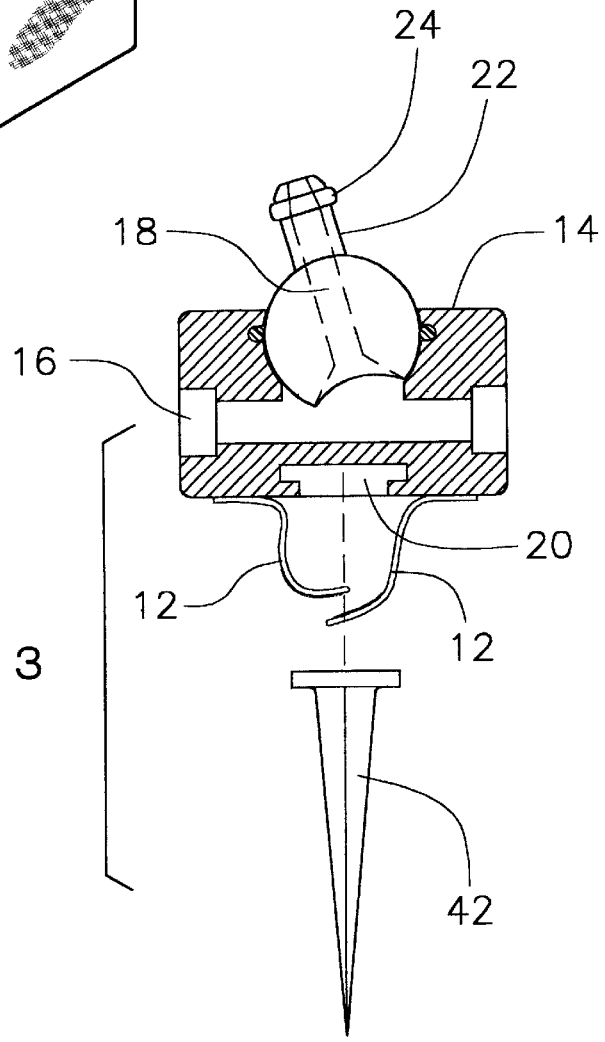
FIG. 3 is a partial section view of the misting nozzle of the water misting device of the present invention.

In FIG. 3, the water misting device 10 of the present invention is illustrated and will be described. The water misting device 10 has the hook and loop fastener 12 connected to the nozzle mounting assembly 14. The nozzle mounting assembly 14 has an inlet tube bore 16. The nozzle mounting assembly 14 has a nozzle bore 18 in hydraulic communication with the inlet tube bore 16. The nozzle mounting assembly 14 has the ground stake bore therein 20. The misting nozzle 22 is attached to the nozzle mounting assembly 14. The misting nozzle 22 is in hydraulic communication with the nozzle mounting assembly nozzle bore 18. The nozzle valve 24 is connected to the misting nozzle 22 for selectively metering the flow of water through the misting nozzle 22. The water inlet tube 26 is in hydraulic communication with the nozzle mounting assembly inlet tube bore 16.

Figure 4:
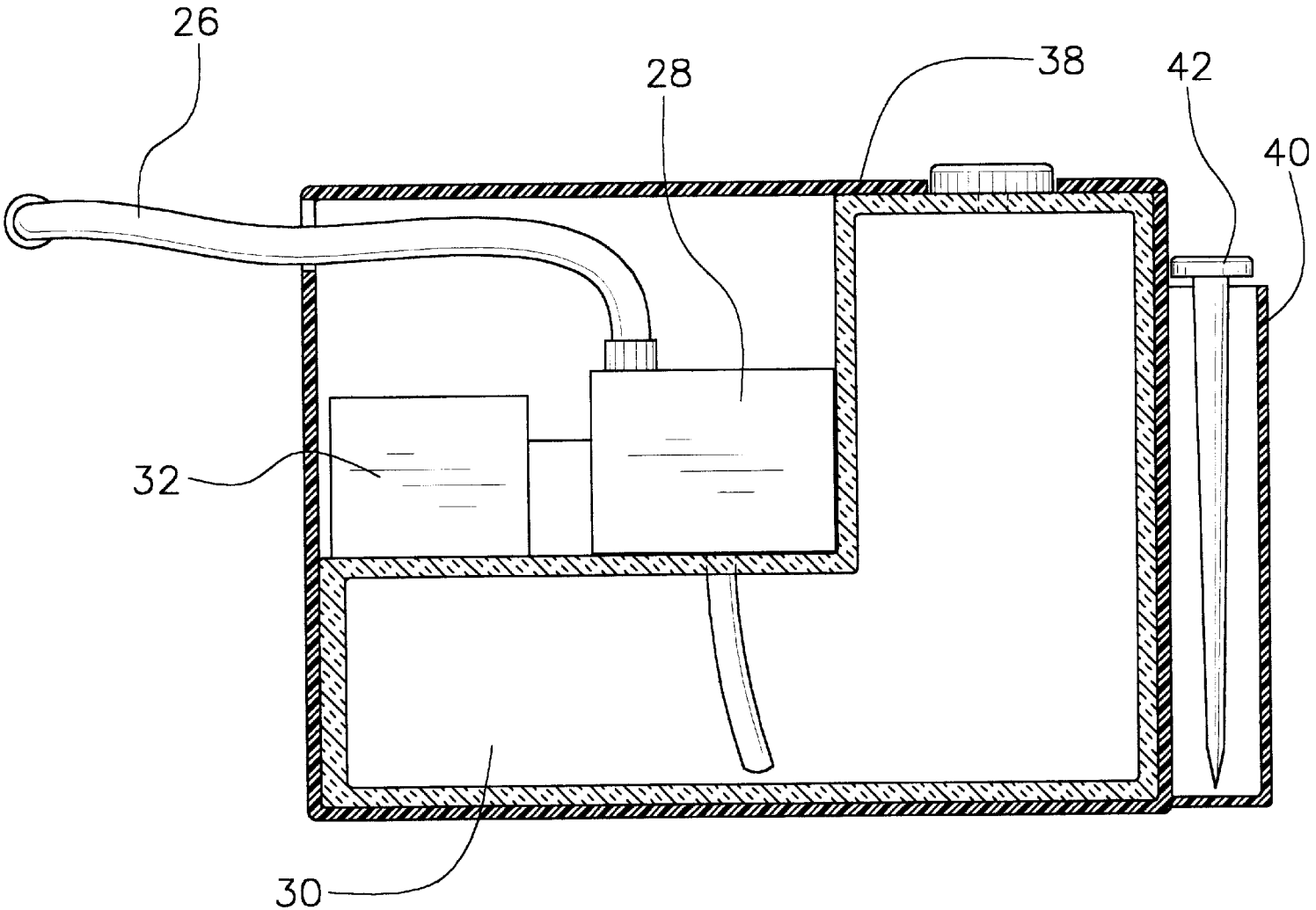
FIG. 4 is a section 4—4 view of FIG. 1 of the water misting device of the present invention.

In FIG. 4, the water misting device 10 of the present invention is illustrated and will be described. The electrically driven water pump 28 is connected to the water inlet tube 26. The water pump 28 is in hydraulic communication with the water inlet tube 26. The water reservoir 30 is connected to the water pump 28. The water reservoir 30 is thermally insulated in the present example. The water reservoir 30 is in hydraulic communication with the water pump 28. The timer 32 is electrically connected to the water pump 28 for selectively powering the water pump 28 to intermittently force the flow of water through the water pump 28. The timer 32 is programmable in the present example. The housing 38 is attached to the water reservoir 30, to the timer 32 and to the water pump 28. The ground stake holder 40 is attached to the housing 38, for holding the ground stake 42.

Figure 5:
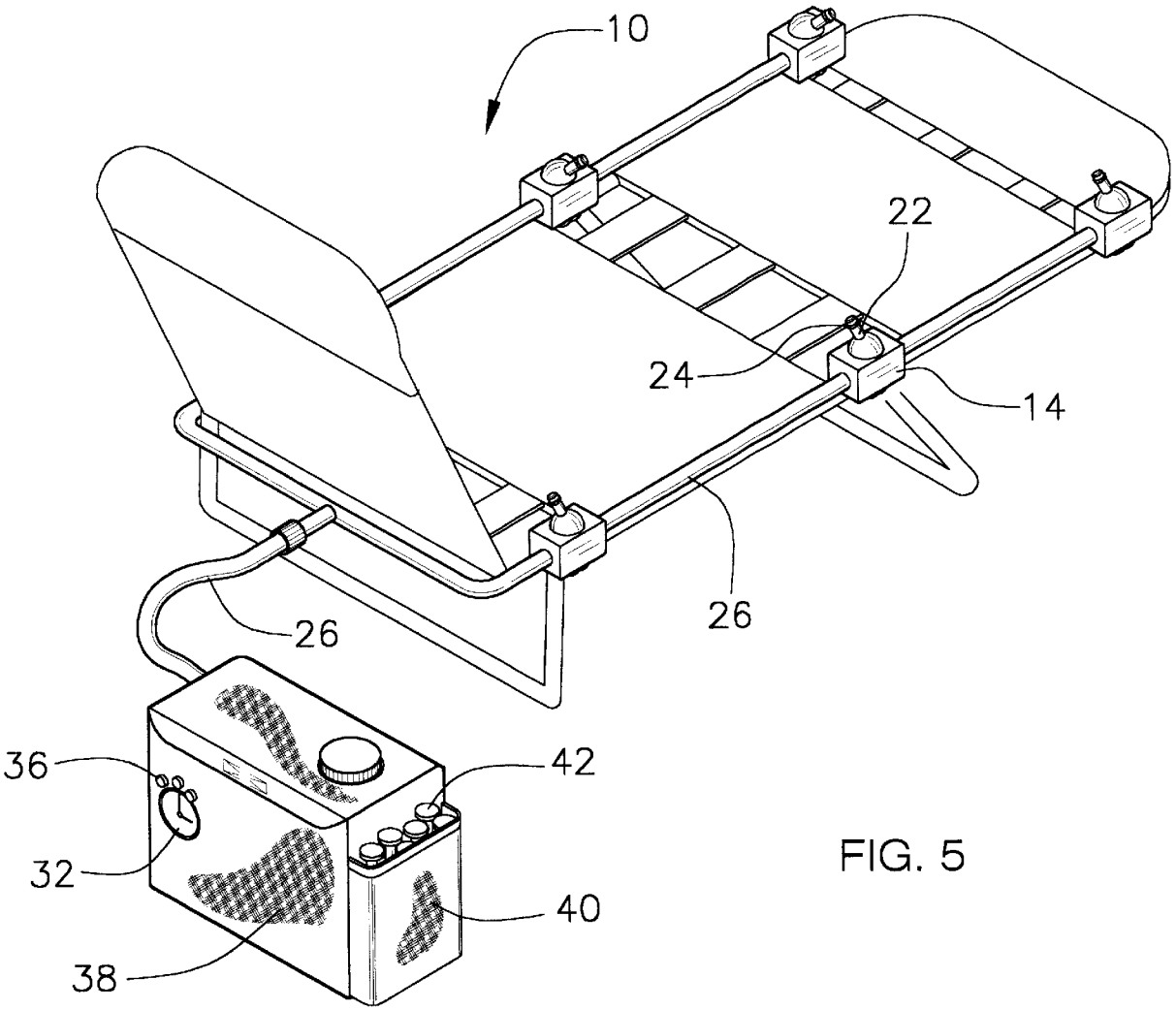
FIG. 5 is a top perspective view of the misting nozzle of the water misting device of the present invention.

In FIG. 5, the water misting device 10 of the present invention is illustrated and will be described. The water misting device 10 has the hook and loop fastener 12 connected to the nozzle mounting assembly 14. The nozzle mounting assembly 14 has the ground stake bore therein 20. The misting nozzle 22 is attached to the nozzle mounting assembly 14. The nozzle valve 24 is connected to the misting nozzle 22 for selectively metering the flow of water through the misting nozzle 22. The water inlet tube 26 is connected to the nozzle mounting assembly 14. The power switch 36 is electrically connected to the timer 32, for selectively powering the timer 32 and the water pump. The housing 38 is attached to the timer 32. The ground stake holder 40 is attached to the housing 38, for holding the ground stake 42.

In use it can now be seen that the water misting device 10 is either connected to the lounge chair with the hook and loop fastener 12, or staked into the ground with the ground stake 42 through the nozzle mounting assembly ground stake bore 20. The water reservoir 30 is filled with water. The power switch 36 is turned on, and the timer 32 is set for the spray interval. The misting nozzle 22 can be turned down or off using the nozzle valve 24 and then adjusted as needed.

While a preferred embodiment of the water misting device has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as metal or composite may be used instead of the plastic described. And although water misting device attachable to a lounge chair have been described, it should be appreciated that the water misting device herein described is also suitable for misting sun effecting solutions onto a user.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A water misting device comprising:

a hook and loop fastener;

a nozzle mounting assembly connected to said hook and loop fastener, said nozzle mounting assembly having an inlet tube bore, said nozzle mounting assembly having a nozzle bore in hydraulic communication with said inlet tube bore;

a misting nozzle attached to said nozzle mounting assembly, said nozzle in hydraulic communication with said nozzle mounting assembly nozzle bore;

a water inlet tube connected to said nozzle mounting assembly, said water inlet tube in hydraulic communication with said nozzle mounting assembly inlet tube bore;

an electrically driven water pump connected to said water inlet tube, said water pump in hydraulic communication with said water inlet tube; and a timer electrically connected to said water pump for selectively powering said water pump to intermittently force the flow of water through said water pump;

a water reservoir connected to said water pump, said water reservoir in hydraulic communication with said water pump;

a housing attached to said water reservoir, said housing attached to said timer, said housing attached to said water pump; and a ground stake holder attached to said housing.

2. The water misting device of claim 1 further comprising:

a ground stake holder attached to said housing.

3. A water misting device comprising:

a nozzle mounting assembly having an inlet tube bore and a ground stake bore therein, said nozzle mounting assembly having a nozzle bore in hydraulic communication with said inlet tube bore;

a misting nozzle attached to said nozzle mounting assembly, said nozzle in hydraulic communication with said nozzle mounting assembly nozzle bore;

a water inlet tube connected to said nozzle mounting assembly, said water inlet tube in hydraulic communication with said nozzle mounting assembly inlet tube bore;

an electrically driven water pump connected to said water inlet tube, said water pump in hydraulic communication with said water inlet tube;

a timer electrically connected to said water pump for selectively powering said water pump to intermittently force the flow of water through said water pump; and a power supply connection electrically connected to said timer.

4. The water misting device of claim 3 further comprising:

a housing attached to said timer, said housing attached to said water pump; and a ground stake holder attached to said housing.

* * * * *